US009364111B1

(12) United States Patent
Christie

(10) Patent No.: US 9,364,111 B1
(45) Date of Patent: Jun. 14, 2016

(54) MILK OR JUICE CARTON HOLDER

(71) Applicant: Curtis Christie, Wellington, FL (US)

(72) Inventor: Curtis Christie, Wellington, FL (US)

( * ) Notice: Subject to any disclaimer, the term of this patent is extended or adjusted under 35 U.S.C. 154(b) by 30 days.

(21) Appl. No.: 14/571,415

(22) Filed: Dec. 16, 2014

(51) Int. Cl.
*A47G 23/02* (2006.01)
*B65D 25/28* (2006.01)

(52) U.S. Cl.
CPC ..... *A47G 23/0258* (2013.01)

(58) Field of Classification Search
CPC ..... A47G 23/02; A47G 23/0258; B65D 25/2811; B65D 25/2805; B65D 23/106; B65D 23/104; B65D 23/10
USPC ..... 220/710.5, 737, 741, 742, 752, 756, 220/758, 759, 762, 768, 771; 215/396
See application file for complete search history.

(56) References Cited

U.S. PATENT DOCUMENTS 2,463,651 A * 3/1949 Stevens ..... A47G 23/0241 215/395
2,730,278 A * 1/1956 Sherlowsky ..... A47G 23/0258 220/741
2,763,414 A 9/1956 Munger
2,810,503 A 10/1957 Krueger
3,024,943 A 3/1962 Yeager
3,262,618 A * 7/1966 Miller ..... A47G 23/0258 220/743
3,326,591 A 6/1967 Richter
D228,335 S * 9/1973 Jackson ..... 220/741
4,964,536 A 10/1990 Vestering
5,259,653 A 11/1993 Jacobsen
D544,760 S 6/2007 Croteau

FOREIGN PATENT DOCUMENTS

WO WO8300852 A1 3/1983

* cited by examiner

*Primary Examiner* — Robert J Hicks
*Assistant Examiner* — Kareen Thomas
(74) *Attorney, Agent, or Firm* — Kyle A. Fletcher, Esq.

(57) ABSTRACT

The milk or juice carton holder is a device allows for the secure transport and easy dispensing of liquid contained in cartons. The milk or juice carton holder attaches to and securely holds milk or juice cartons. It has a handle to allow for a secure grip and greater control by the user.

17 Claims, 4 Drawing Sheets

MILK OR JUICE CARTON HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of beverage storage and dispensing, more specifically, an accessory configured for use as a handle with beverage cartons.

SUMMARY OF INVENTION

The milk or juice carton holder is a device allows for the secure transport and easy dispensing of liquid contained in cartons. The milk or juice carton holder attaches to and securely holds milk or juice cartons. It has a handle to allow for a secure grip and greater control by the user.

These together with additional objects, features and advantages of the milk or juice carton holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the milk or juice carton holder in detail, it is to be understood that the milk or juice carton holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the milk or juice carton holder.

It is therefore important that the claims be regarded as including such equivalent construction insofar as they do not depart from the spirit and scope of the milk or juice carton holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
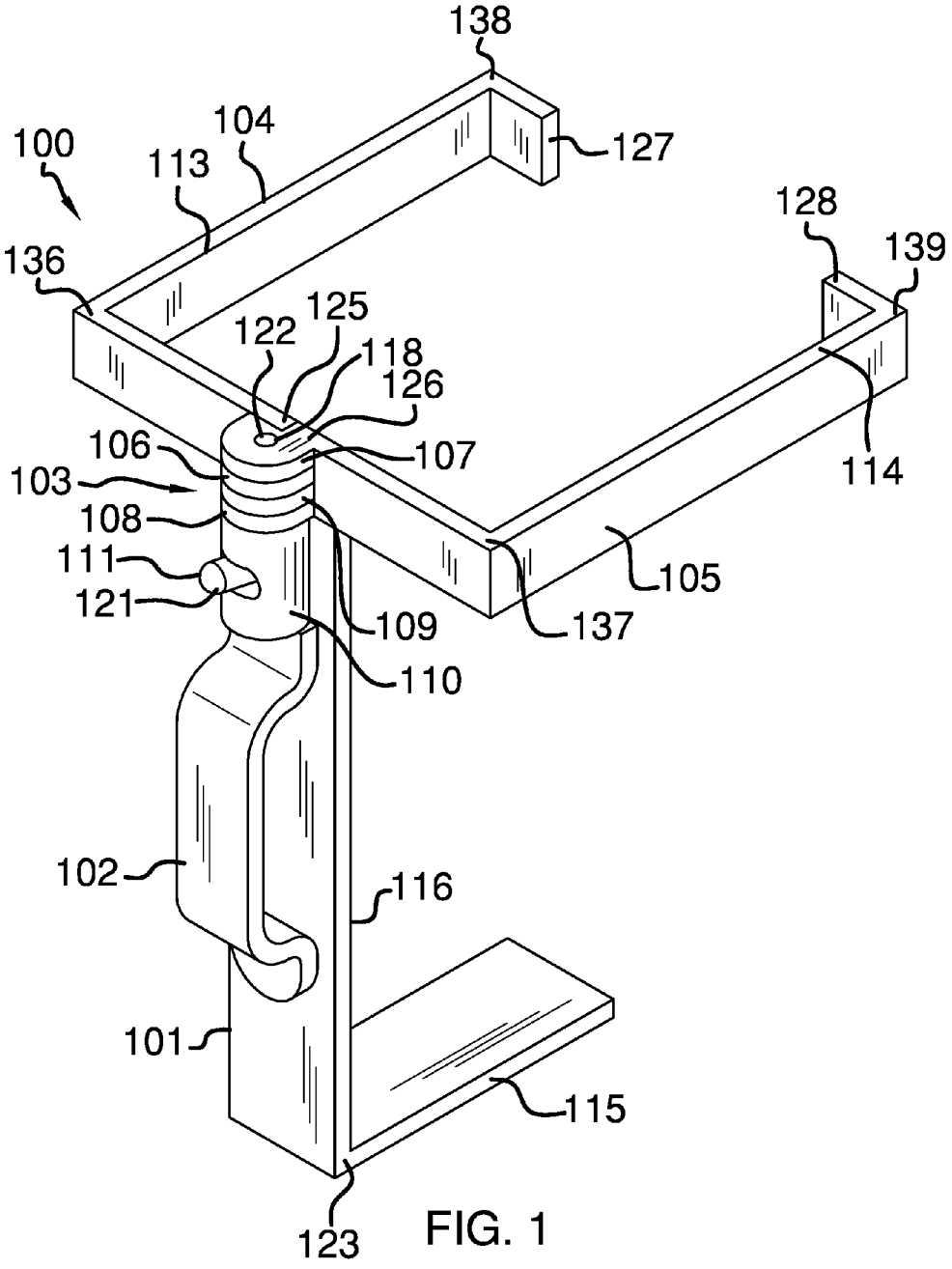
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In the specification and claims, the following definitions will be used:

Carton: In this disclosure, the term carton means a box or container that is essentially rectangular in shape and that is used to contain a volume of no more than 4 liters. As a practical example of this definition, a carton 140 is usually made of a waxed cardboard or plastic and often contains beverages or foodstuffs.

The following directional references will be used with a carton 140. The side of the carton 140 that is intended to rest on a surface when not in use is called the bottom of the carton 131. The side of the carton 140 that is distal from the bottom of the carton 131 and out of which the contents of the carton 140 are poured is called the top of the carton 130. The side adjacent to the top of the carton 130 out of which the fluid will also flow is called the front of the carton 132. When viewed from the top of the carton 130 and moving in a clockwise direction from the front of the carton 132 the remaining sides are called (in order) the right side of the carton 134, the back of the carton 133, and the left side of the carton 135.

Detailed reference will now be made to a first potential embodiment of the disclosure, which is illustrated in FIGS. 1 through 5. The milk or juice carton holder 100 (hereinafter invention) comprises an L brace 101, a handle 102, a hinge 103, a left clamp 104 and a right clamp 105.

The hinge 103 comprises a first left clamp knuckle 106, a second right clamp knuckle 107, a third left clamp knuckle 108, a fourth right clamp knuckle 109, a sleeve 110, a thumb post 111, and a spring 112.

The first left clamp knuckle 106 and the third left clamp knuckle 108 are formed as part of the left clamp 104. The first left clamp knuckle 106 and the third left clamp knuckle 108 both extend away from the back of the carton 133 and both are essentially circular in shape. A first circular hole 117 is formed at a center axis 200 that forms the first left clamp knuckle 106. A third circular hole 119 is formed at the center axis 200 that forms the third left clamp knuckle 108.

The second right clamp knuckle 107 and the fourth right clamp knuckle 109 are formed as part of the right clamp 105. The second right clamp knuckle 107 and the fourth right clamp knuckle 109 both extend away from the back of the carton 133 and both are essentially circular in shape. A second circular hole 118 is formed at the center axis 200 that forms the second right clamp knuckle 107. A fourth circular hole

120 is formed at the center axis 200 that forms the fourth right clamp knuckle 109. A depression is formed in the face of the fourth right clamp knuckle 109 on the side facing the bottom of the carton 131.

The first left clamp knuckle 106 and the third left clamp knuckle 108 are formed on the left clamp 104 so that the centers of the first circular hole 117 and third circular hole 119 are aligned, and are concentric with the center axis 200. The first left clamp knuckle 106 and the third left clamp knuckle 108 are also formed with enough space between them so that the second right clamp knuckle 107 and the fourth right clamp knuckle 109 will interleaf with them. The second right clamp knuckle 107 and the fourth right clamp knuckle 109 are formed so that that centers of the second circular hole 118 and fourth circular hole 120 are aligned and will later align with the first circular hole 117 and third circular hole 119. The second right clamp knuckle 107 and the fourth right clamp knuckle 109 are also formed with enough space between them so that the first left clamp knuckle 106 and the third left clamp knuckle 108 will interleaf with them.

The thumb post 111 comprises a thumb lever 121 and a hinge pin 122. When the invention 100 is assembled, the hinge pin 122 is inserted through the first circular hole 117, second circular hole 118, third circular hole 119, and fourth circular hole 120. The hinge pin 122 acts as the pivot point around which the first left clamp knuckle 106, second right clamp knuckle 107, third left clamp knuckle 108, and fourth right clamp knuckle 109 rotate when the left clamp 104 and right clamp 105 open or close to adaptively receive a carton 140.

The thumb lever 121 is a small post that extends perpendicularly away from the hinge pin 122. The purpose of the thumb lever 121 is open and close the left clamp 104 and right clamp 105. When the thumb lever 121 is pushed to one side, it opens the spring 112, which pushes open the left clamp 104 and right clamp 105. When the thumb lever 121 is released the spring 112 relaxes bringing the left clamp 104 and right clamp 105 into the closed position.

The spring 112 is a helical torsion spring that is placed in the space created by a cavity 201 formed in the third left clamp knuckle 108 and the fourth right clamp knuckle 109. The purpose of the spring 112 is to hold the left clamp 104 and the right clamp 105 in the closed position. A first arm 202 of the spring 112 is attached to the hinge pin 122 so that when the thumb lever 121 is moved, the arm of the spring 112 also rotates with the hinge pin 122 allowing the left clamp 104 and right clamp 105 to open.

The sleeve 110 is a structure attached to the L brace 101. The purpose of the sleeve 110 is to support the first left clamp knuckle 106, second right clamp knuckle 107, third left clamp knuckle 108, fourth right clamp knuckle 109 and to provide a housing for thumb post 111.

Figure 5:
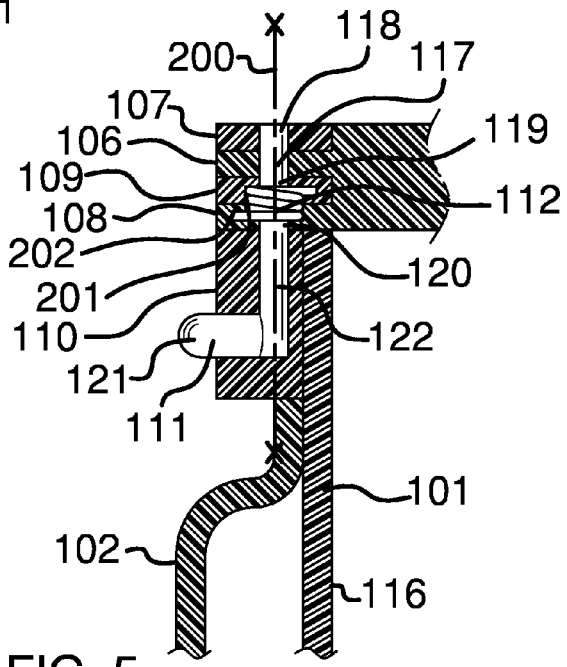
FIG. 5 is a detailed view of an embodiment of the disclosure.

In the first potential embodiment of the invention 100, as illustrated in FIGS. 1 and 5, the hinge 103 is assembled as follows. The thumb post 111 is inserted into the sleeve 110 so that the hinge pin 122 faces out and away from the sleeve 110 towards the top of the carton 130.

The first left clamp knuckle 106, second right clamp knuckle 107, third left clamp knuckle 108, fourth right clamp knuckle 109 are interleafed in the following order (from the top of the carton 130 towards the bottom of the carton 131) second right clamp knuckle 107, first left clamp knuckle 106, fourth right clamp knuckle 109, and third left clamp knuckle 108. Before interleafing, the spring 112 is compressed into the depression of the third left clamp knuckle 108 so that once the interleafing is completed, the spring 112 is in position.

After the first left clamp knuckle 106, second right clamp knuckle 107, third left clamp knuckle 108, fourth right clamp knuckle 109 are interleafed, the aligned first circular hole 117, second circular hole 118, third circular hole 119 and fourth circular hole 120 are aligned and can be placed over the hinge pin 122.

Figure 2:
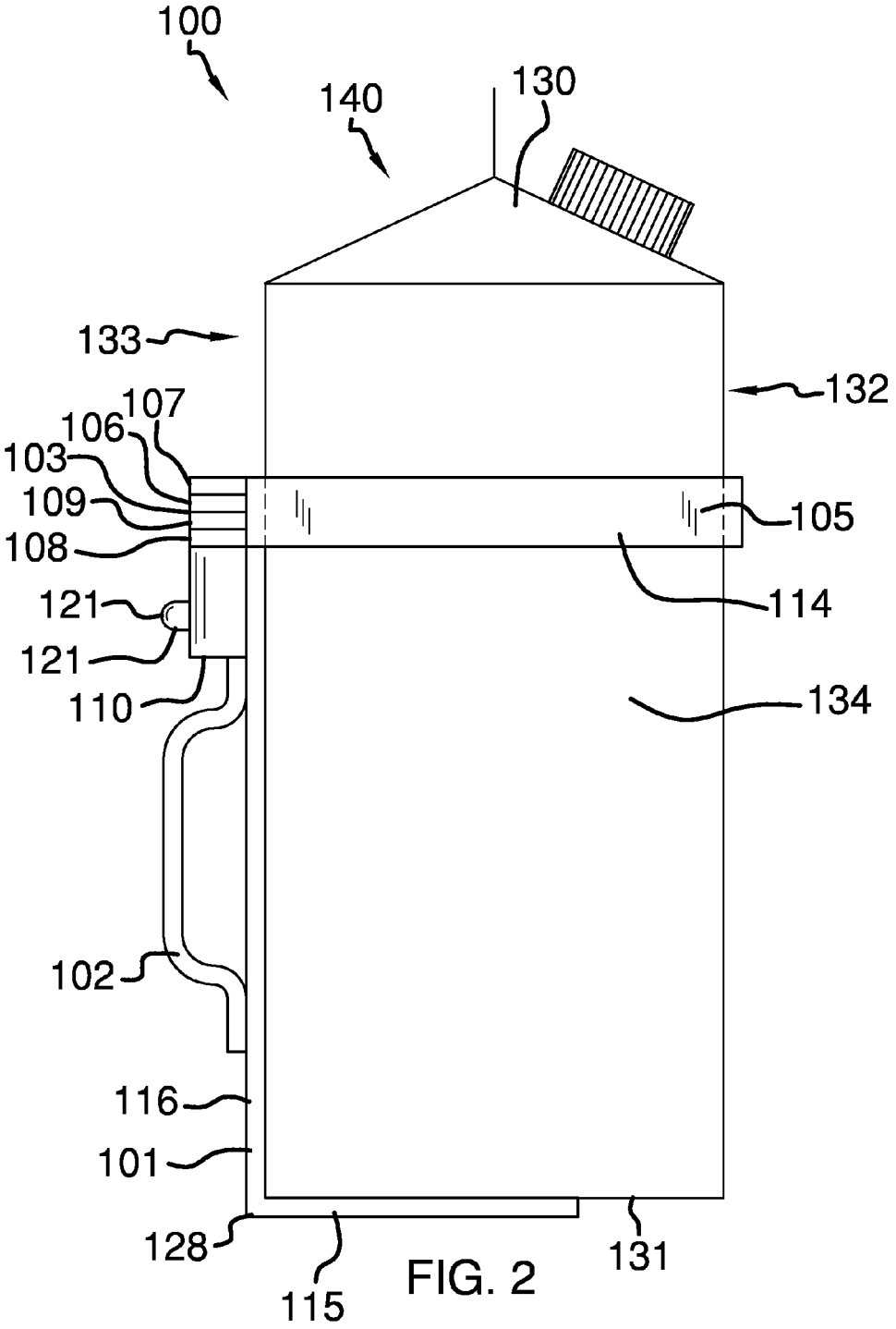
FIG. 2 is a side view of an embodiment of the disclosure.

As shown most clearly in FIGS. 1 and 2 of the first potential embodiment of the invention 100, the L brace 101 is an "L" shaped plastic strut, which acts as the structural base of the invention 100. The L brace 101 comprises the bottom brace 115 and the back brace 116. The bottom brace 115 and back brace 116 are rigid strips of material that are combined into an "L" that are used to hold and secure the carton 140. The bottom brace 115 is a rigid piece of material that is used to support the bottom of the carton 131. The back brace 116 is a rigid piece of material that is used to support the back of the carton 133. The bottom brace 115 and the back brace 116 are formed into an "L" shape at a fifth right angle 123. The handle 102 is a "U" shaped utensil that is attached to the L brace 101. The purpose of the handle 102 is to provide the user with a convenient way to hold, carry and control the invention 100.

Figure 3:
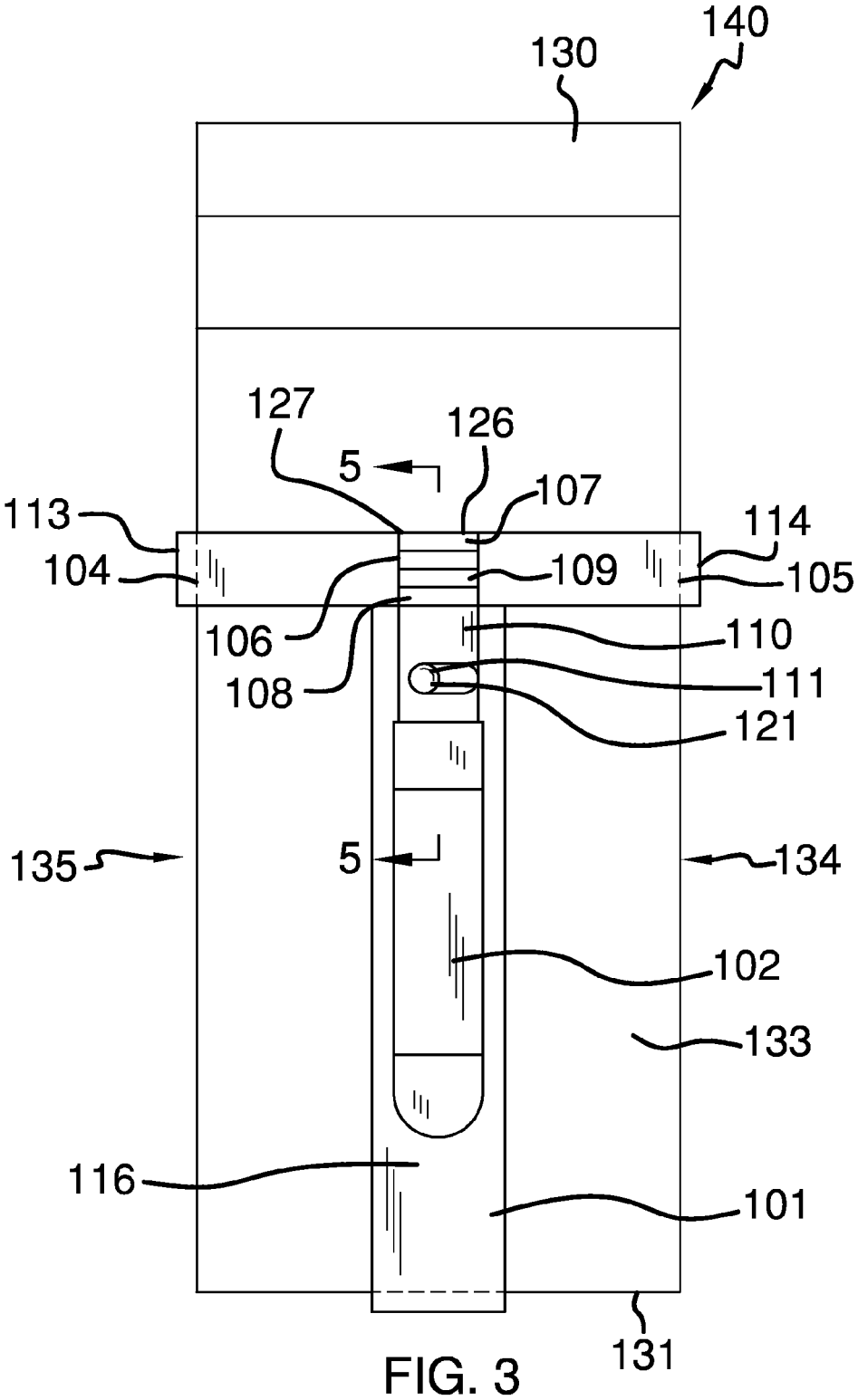
FIG. 3 is a rear view of an embodiment of the disclosure.

As shown most clearly in FIGS. 1 through 3 of the first potential embodiment of the invention 100, the left clamp 104 comprises a left grip 113, first left clamp knuckle 106 and third left clamp knuckle 108. The first left clamp knuckle 106 and third left clamp knuckle 108 are discussed elsewhere in this disclosure. The left grip 113 is a rigid strip of material that is used to secure the front of the carton 132, left side of the carton 135, and back of the carton 133. The left grip 113 has a first end 125 and a third end 127. The first left clamp knuckle 106 and third left clamp knuckle 108 are located at the first end 125.

The left grip 113 extends from the first end 125 along the back of the carton 133 towards the left side of the carton 135. At the left side of the carton 135, the left grip 113 has formed in it a first right angle 136 that allows the left grip 113 to extend along the face of the left side of the carton 135 to the front of the carton 132. At the front of the carton 132, the left grip 113 has formed in it a third right angle 138 that allows the left grip 113 to extend partially along the front of the carton 132. The left grip 113 terminates at the third end 127 of the left grip 113.

As shown most clearly in FIGS. 1 through 3 of the first potential embodiment of the invention 100, the right clamp 105 comprises a right grip 114, second right clamp knuckle 107 and fourth right clamp knuckle 109. The second right clamp knuckle and fourth right clamp knuckle 109 are discussed elsewhere in this disclosure. The right grip 114 is a rigid strip of material that is used to adaptively secure the front of the carton 132, right side of the carton 134, and back of the carton 133. The right grip 114 has a second end 126 and a fourth end 128. The second right clamp knuckle 107 and fourth right clamp knuckle 109 are located at the second end 126. The right grip 114 extends from the second end 126 along the back of the carton 133 towards the right side of the carton 134. At the right side of the carton 134, the right grip 114 has formed in it a second right angle 137 that allows the right grip 114 to adaptively extend along the face of the right side of the carton 134 to the front of the carton 132. At the front of the carton 132, the right grip 114 has formed in it a fourth right angle 139 that allows the right grip 114 to extend partially along the front of the carton 132. The right grip 114 terminates at the fourth end 128 of the right grip 114.

The L brace 101, handle 102, and sleeve 110 are formed as a single unit of molded plastic. The left clamp 104 is formed as a single unit of molded plastic. The right clamp 105 is formed as a single unit of molded plastic. The thumb post 111 can be formed as a single piece of molded plastic or, alternatively, the thumb lever 121 and hinge pin 122 may be made separately made of molded plastic and fitted together using screws or some other joining mechanism. The spring 112 is a commercially available torsion spring. The plastic used in making the components of this invention 100 include, but are not limited to, polypropylene, polyethylene, or polycarbonate.

Figure 4:
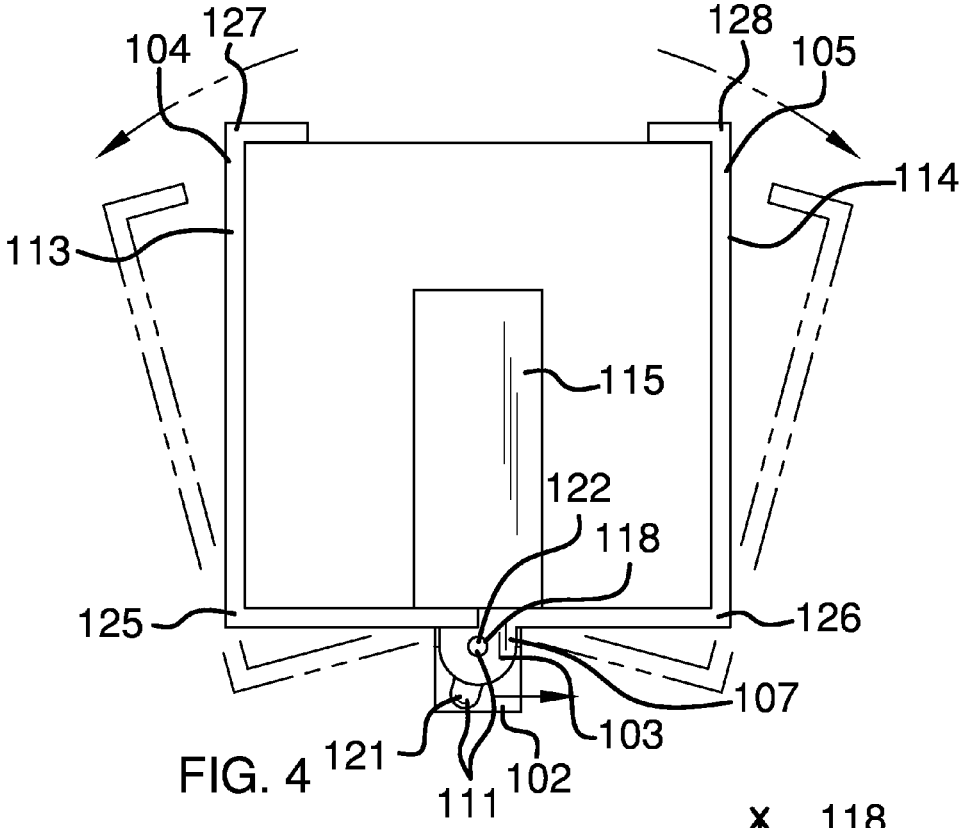
FIG. 4 is a top view of an embodiment of the disclosure.

As shown most clearly in FIG. 4 of the first potential embodiment of the invention 100, the invention 100 is placed on a table and the user pushes the thumb lever 121 to the side. When the thumb lever 121 is pushed, the left clamp 104 and the right clamp 105 rotate outwards increasing the space available to insert the carton 140. The carton 140 is placed so that the bottom of the carton 131 rests on the on bottom brace 115. Once the carton 140 is in position, the user releases the thumb lever 121 and the left clamp 104 and right clamp 105 rotate back into position.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A beverage carton holder comprising:

an L brace;

a handle;

a hinge;

a left clamp, and a right clamp;

wherein the L brace, the left clamp, and the right clamp are adapted to hold a carton thereon;

wherein the handle is manually grabbed in order to adaptively manipulate the carton;

wherein the hinge comprises a first left clamp knuckle, a second right clamp knuckle, a third left clamp knuckle, a fourth right clamp knuckle, a sleeve, a thumb post, and a spring.

2. The beverage carton holder according to claim 1 wherein the first left clamp knuckle and the third left clamp knuckle are formed as part of the left clamp; wherein the first left clamp knuckle and the third left clamp knuckle both adaptively extend away from a back of the carton.

3. The beverage carton holder according to claim 2 wherein a first circular hole is formed at a center axis that forms the first left clamp knuckle; wherein a third circular hole is formed at the center axis that forms the third left clamp knuckle.

4. The beverage carton holder according to claim 3 wherein the second right clamp knuckle and the fourth right clamp knuckle are a part of the right clamp; wherein the second right clamp knuckle and the fourth right clamp knuckle adaptively extend away from the back of the carton.

5. The beverage carton holder according to claim 4 wherein a second circular hole is formed at the center axis that forms the second right clamp knuckle; wherein a fourth circular hole is formed at the center axis that forms the fourth right clamp knuckle.

6. The beverage carton holder according to claim 5 wherein the first left clamp knuckle and the third left clamp knuckle are formed on the left clamp so that the centers of the first circular hole and third circular hole are aligned, and are concentric with the center axis.

7. The beverage carton holder according to claim 6 wherein the first left clamp knuckle and the third left clamp knuckle are also formed with enough clearance between them so that the second right clamp knuckle and the fourth right clamp knuckle will interleaf with them.

8. The beverage carton holder according to claim 7 wherein the second right clamp knuckle and the fourth right clamp knuckle are formed so that that centers of the second circular hole and fourth circular hole are aligned and will later align with the first circular hole and third circular hole; wherein the second right clamp knuckle and the fourth right clamp knuckle are also formed with enough space between them so that the first left clamp knuckle and the third left clamp knuckle will interleaf with them.

9. The beverage carton holder according to claim 8 wherein the thumb post comprises a thumb lever and a hinge pin; wherein the hinge pin extends through the first circular hole, the second circular hole, the third circular hole, and the fourth circular hole; wherein the hinge pin acts as the pivot point around which the first left clamp knuckle, the second right clamp knuckle, the third left clamp knuckle, and the fourth right clamp knuckle rotate when the left clamp and right clamp open or close to adaptively receive a carton.

10. The beverage carton holder according to claim 9 wherein the thumb lever extends perpendicularly away from the hinge pin; wherein the thumb lever is pushed to one side, which pushes open the left clamp and right clamp; wherein once the thumb lever is released the spring relaxes bringing the left clamp and right clamp into a closed position.

11. The beverage carton holder according to claim 10 wherein the spring is placed in a cavity formed in the third left clamp knuckle and the fourth right clamp knuckle; wherein the spring holds the left clamp and the right clamp in the closed position; wherein a first arm of the spring is attached to the hinge pin so that when the thumb lever is moved, the arm of the spring also rotates with the hinge pin allowing the left clamp and right clamp to open.

12. The beverage carton holder according to claim 11 wherein the sleeve is attached to the L brace; wherein the sleeve supports the first left clamp knuckle, the second right clamp knuckle, the third left clamp knuckle, the fourth right clamp knuckle; wherein the sleeve also provides a housing for thumb post.

13. The beverage carton holder according to claim 12 wherein the L brace comprises the bottom brace and the back brace; wherein the bottom brace and the back brace are rigid strips of material that are combined into an "L" that are adaptively used to hold and secure the carton; wherein the bottom brace is a rigid piece of material that is adaptively used to support the bottom of the carton; wherein the back brace is a rigid piece of material that is adaptively used to support the back of the carton; wherein the bottom brace and the back brace are formed into an "L" shape at a fifth right angle; wherein the handle is a "U" shaped utensil that is attached to the L brace.

14. The beverage carton holder according to claim 13 wherein the left clamp comprises a left grip, first left clamp knuckle, and third left clamp knuckle; wherein the left grip is adaptively used to secure the front of the carton, left side of the carton, and back of the carton; wherein the left grip has a first end and a third end; wherein the first left clamp knuckle and third left clamp knuckle are located at the first end.

15. The beverage carton holder according to claim 14 wherein the left grip adaptively extends from the first end along the back of the carton towards the left side of the carton; wherein the left grip includes a first right angle that allows the left grip to adaptively extend along the face of the left side of the carton to the front of the carton; wherein the left grip includes a third right angle that enables the left grip to adaptively extend partially along the front of the carton; wherein the left grip terminates at the third end of the left grip.

16. The beverage carton holder according to claim 15 wherein the right clamp comprises a right grip, second right clamp knuckle, and fourth right clamp knuckle; wherein the right grip is adaptively used to adaptively secure the front of the carton, right side of the carton, and back of the carton; wherein the right grip has a second end and a fourth end; wherein the second right clamp knuckle and fourth right clamp knuckle are located at the second end; wherein the right grip adaptively extends from the second end along the back of the carton towards the right side of the carton.

17. The beverage carton holder according to claim 16 wherein the right grip includes a second right angle that allows the right grip to adaptively extend along the face of the right side of the carton to the front of the carton; wherein the right grip is further defined with a fourth right angle that allows the right grip to adaptively extend partially along the front of the carton; wherein the right grip terminates at the fourth end of the right grip.

* * * * *